US006513879B1

(12) United States Patent
Stern

(10) Patent No.: US 6,513,879 B1
(45) Date of Patent: Feb. 4, 2003

(54) CHAIR ADJUSTMENT MECHANISM

(75) Inventor: Douglas E. Stern, Providence, RI (US)

(73) Assignee: Fulcrum Product Development Inc., Providence, RI (US)

( * ) Notice: Subject to any disclaimer, the term of this patent is extended or adjusted under 35 U.S.C. 154(b) by 51 days.

(21) Appl. No.: 09/712,841

(22) Filed: Nov. 15, 2000

(51) Int. Cl.[7] ..... A47C 1/032

(52) U.S. Cl. ..... 297/463.1; 297/300.3; 297/302.2

(58) Field of Search ..... 297/300.3, 301.2, 297/302.2, 463.1

(56) References Cited

U.S. PATENT DOCUMENTS

| | | | | | |
|---|---|---|---|---|---|
| 4,364,605 | A | * | 12/1982 | Meiller | 297/300.8 |
| 4,408,800 | A | * | 10/1983 | Knapp | 297/301.2 |
| 4,589,697 | A | * | 5/1986 | Bauer et al. | 297/301.2 |
| 4,743,065 | A | * | 5/1988 | Meiller et al. | 297/300.3 |
| 4,838,510 | A | * | 6/1989 | Holstensson | 297/300.8 |

* cited by examiner

*Primary Examiner*—Peter R. Brown

(57) ABSTRACT

This patent relates to ergonomically correct seating during long periods of time, especially for professionals who work with hands extended like dentists and hand surgeons, but also computer users and other office or assembly workers. While the immediate comfort is provided by the shape of the seat and the backrest and by the upholstery, the long time comfort is determined by proper sitting posture. Comfortable sitting posture is individual and requires a large range of adjustments for height, seat inclination and the positioning of the back support relative to the seat.

Recognizing the importance of these adjustments—not only for comfort but also for avoiding back problems—this adjustment mechanism is designed to accomplish all three adjustments with a single lever. The mechanism is designed for use with the lever mounted on the right side or the left side of the chair to accommodate personal preferences. To avoid seat adjustment errors, which can be disastrous during surgical procedures, the three movements are arranged in a logical manner. In addition, the mechanism offers a 20° adjustment range for the seat inclination.

9 Claims, 6 Drawing Sheets

CHAIR ADJUSTMENT MECHANISM

FIELD OF INVENTION

The present invention relates generally to a mechanism for the control of seated body support and more specifically to the adjustment movements of an ergonomically correct chair.

BACKGROUND OF THE INVENTION

Ergonomically correct seating for work has been of concern for many years. It not only reduces the fatigue at the end of the day but it also contributes to the long-term health of the spinal column. Given the importance of proper posture while sitting, it is not surprising that many different mechanisms have been developed to accommodate the three most important seating adjustments: seat height, seat inclination, and the back support adjustment.

The prior art patents, dating back to 1947, are typical for the style and technology of the day. The technology disclosed is outdated and does not meet today's product safety requirements. The adjustments proposed by Harman in 1947 (U.S. Pat. No. 420,7452) and by Hamilton in 1966 (U.S. Pat. No. 3,338,626) are based on hand wheels, worm gears, and cylindrical springs in which fingers can get caught. In 1968, Hasbrouck (U.S. Pat. No. 3,361,472) introduced a stool with an adjustable semi-circular back support that can also serve as armrest, though it does not offer a seat tilt adjustment. Interesting is the Scheben design of 1975 (U.S. Pat. No. 3,880,465) that was the first to introduce gas springs for seat height and back support adjustment with a single lever; however, the design does not provide for an adjustment of the seat tilt and uses separate levers for the two adjustments.

The 1981 patent of Aaras et. al. (U.S. Pat. No. 4,277,102) introduces the unchanged seat-to-backrest relation throughout the range of adjustment. It also introduces the concept of armrests being adjustable in all directions. The embodiment shown invites further development to bring the revealed ideas to fruition.

The 1982 Meiller patent (U.S. Pat. No. 4,364,605), referring back to the Scheben patent, proposes a more elegant arrangement of gas springs for height and backrest adjustment activated by a single lever. Meiller did not follow Aaras' idea of an unchanged seat-to-backrest relation when the seat inclination is changed. By contrast, in 1987 Steifensand (U.S. Pat. No. 4,682,815) introduces the combination of gas springs with an unchanged seat-to-backrest relation. In 1995, Dauphin was granted the U.S. Pat. No. 5,447,357 for an adjustment mechanism that uses one lever to activate a clutch-like release and lock arrangement for the seat inclination and seating height and a second lever for the gas spring adjustment of the back support. This patent, first applied for in Germany in 1992, uses a different approach to maintain the seat-to-backrest relation. Dauphin calls it a "synchronous" mechanism.

Since then, several mechanism have come onto the market that use a single lever for the adjustments of seating height, seat inclination, and backrest, apparently not all being covered by patents.

Today, the value of maintaining the seat-to-back relation throughout the adjustment range of the seat inclination is being reconsidered for the simple reason that the body posture changes with the inclination of the seat. For this reason, the present invention by Stem keeps the backrest floating while the seat tilt is being adjusted. When the seat is properly tilted for the work at hand and locked into position, the backrest can still be adjusted to a comfortable position and then be locked by releasing the lever into its resting position. Both these adjustments and the seat height positioning are accomplished by means of a single lever and are executed by lever motions that are analogous to the specific adjustment movement to avoid confusion. Earlier designs that offered no analogy between control motions and adjustment motions often created problems, especially in dental or surgical situations where seating adjustments must be made quickly and safely.

SUMMARY OF THE INVENTION

The chair adjustment mechanism, subject of this invention, is based on the use of three gas springs for the three adjustments, all activated by a single lever by means of a central multi-action cam.

The multi-action cam allows for a design more compact than any design previously patented. Most importantly, the lever movements correspond logically to the adjustment movements to avoid erroneous manipulations that could result in accidents. Medical professionals, especially dentists and surgeons, must be able to adjust their stools quickly and without thinking about the coordination of non-coordinated movements. At present, even high-end chairs do not offer easy-to-understand adjustment features. The preferred embodiment of the multi-action cam features three distinct cams each of which controls a different adjustment movement. The subject invention works logically: (1) Lift the lever to adjust the seat height. (2) Push the lever backwards to adjust the back support. (3) Push the lever even further back, beyond a certain resistance, to adjust the seat tilt. When the tilt is in the desired position, it will be locked when the lever moves forward to the intermediate position. At this point, the back support can still be adjusted. Then, when the lever returns to the resting position, all three adjustments seat height, seat tilt, and back support are locked in place.

Additionally, due to the symmetry of the multi-action cam, the adjustment lever can be mounted on the right side for right-handed persons, or on the left side for left-handed persons.

The seat can be inclined, using the lever, for a 10° range for a fine adjustment. In addition, it can be set in one of two basic positions that are 10° apart for a coarse adjustment, thus offering a total adjustment range of 20° to accommodate different work habits and regional preferences.

The use of the multi-action cam can also be designed to activate electrical switches or additional levers or mechanical functions if needed.

DETAILED DESCRIPTION OF THE DRAWINGS

Figure 1:
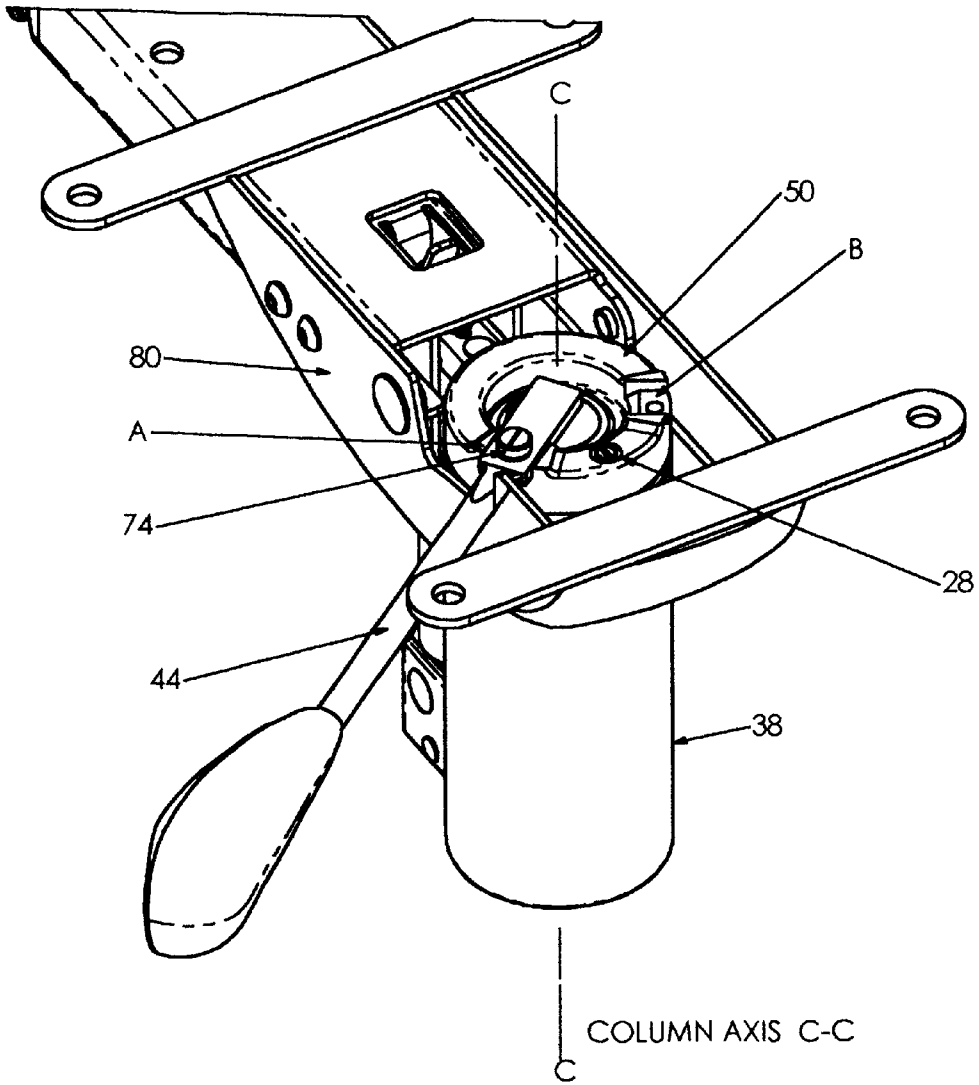
FIG. 1 shows the multi action cam assembly with the lever arm (44) that controls the adjustment actions

Referring to FIG. 1, the multi action cam assembly is shown mounted at the top of the column tube (38) of the chair, showing the lever (44) attached to the multi action rotational cam (50) by means of a shoulder screw (74). A ball plunger (28) indexes the action positions of the multi action rotational cam (50). The lever (44) can be installed in position A for right-handed users or in position B for left-handed users. (For left hand use, tilt frame (80) must have the lever space notched out on the other side). The surfaces on the multi action rotational cam (50) are arranged symmetrically, and therefore the adjustments work in the same manner in either position, A or B. The seat height gas spring (62, FIG. 3) is mounted co-axially with the chair column and is covered by the column tube (38).

Figure 2A:
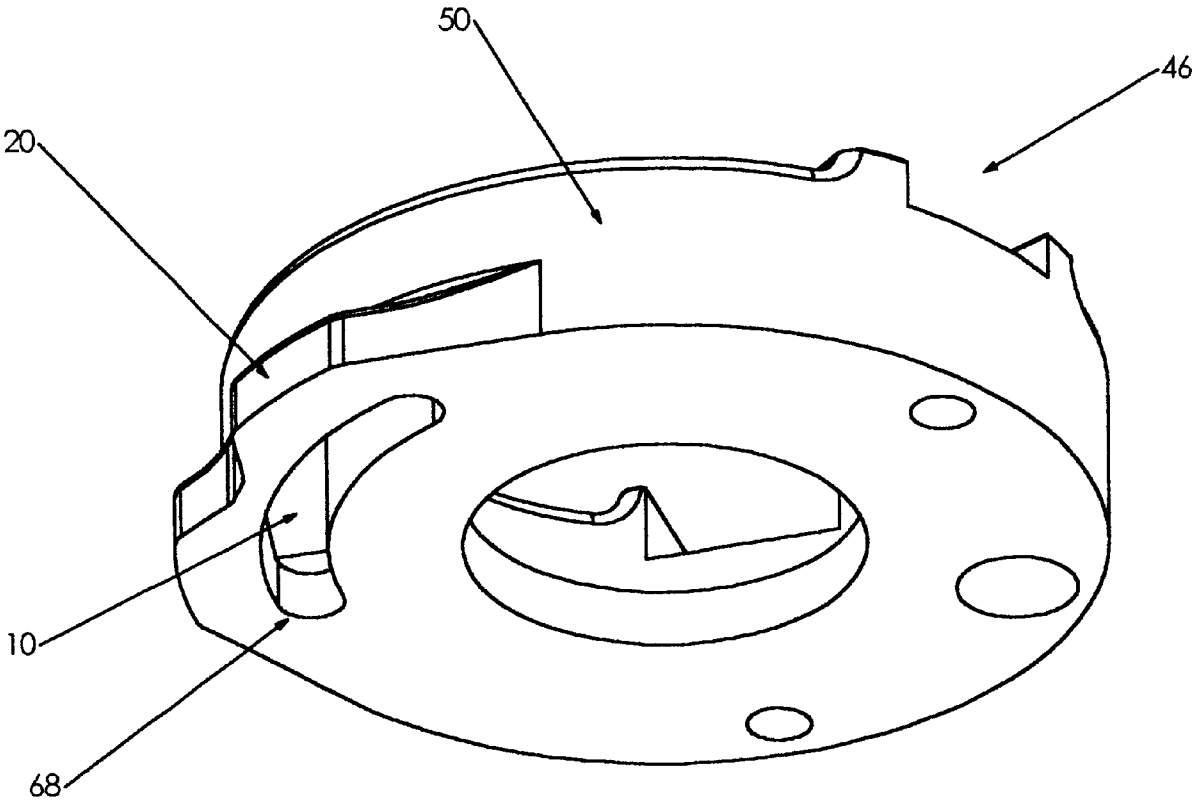
FIG. 2*a* shows the underside of the multi action cam (50) with a seat tilt cam (68), and with the back tilt cam (20)

FIG. 2*a* shows the multi action cam (50) in more detail, showing the back tilt cam (20) in the form of radial protrusions on the outside, and the seat tilt cam (68) in the form of a coaxial slot with varying depth that includes the activation slope (10). It also shows the mounting position (46) of the lever for the seat height adjustment.

Figure 3:
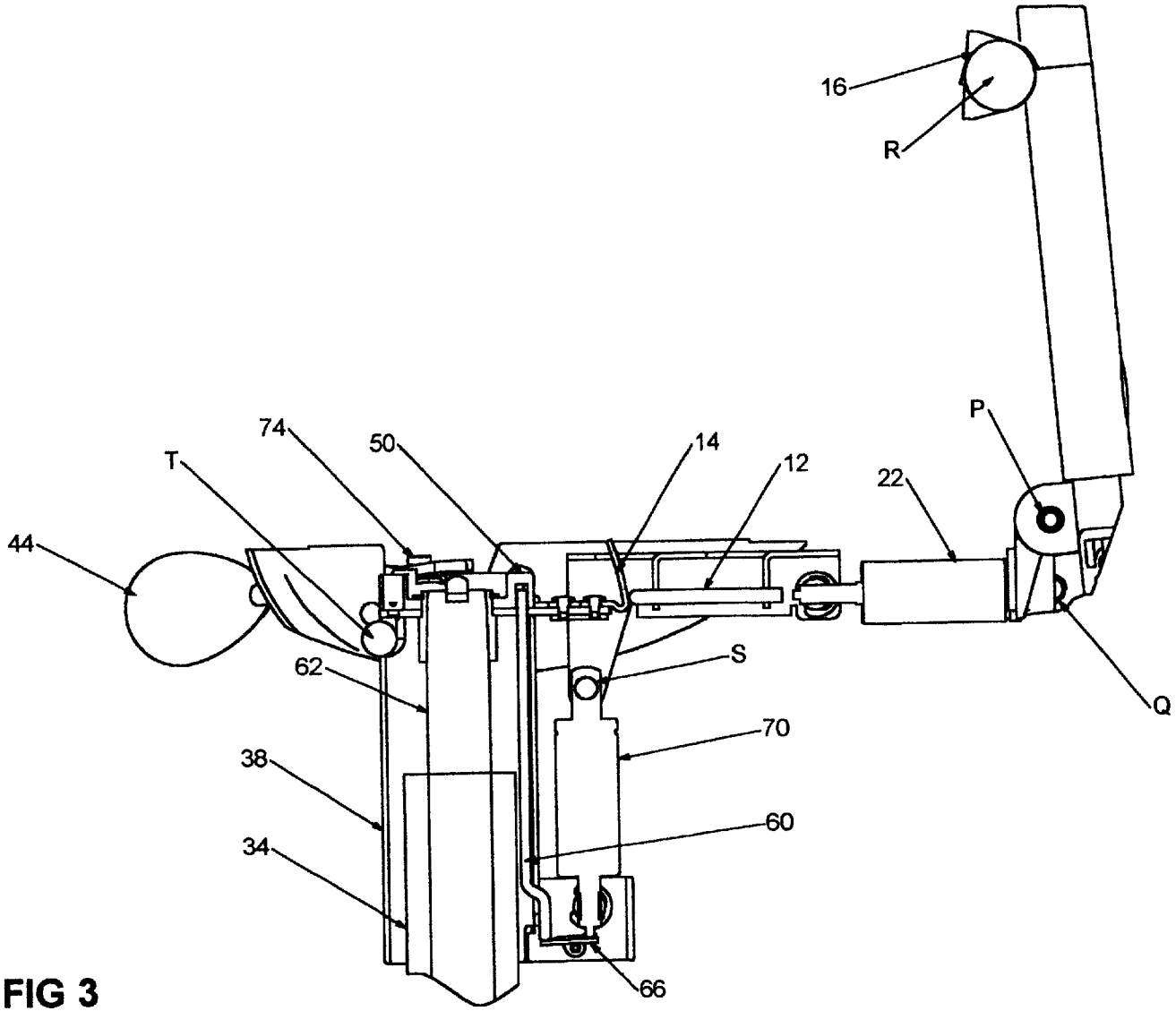
FIG. 3 shows the geometric arrangement of lever (44) and multi-action cam (50) in relation to the seat height cylinder (62), the seat tilt gas spring (70), and the back tilt gas spring (22).

FIGS. 2*a* and 3 illustrate the basic functions of the mechanism:

A. Seat height adjustment. The lever (44) is mounted inside the multi action rotational cam (50) by means of a shoulder screw (74) and a lever spring (48). The lever spring (48) serves to provide adequate space for the vertical movement of the lever (44) needed for the seat height adjustment, then to push it back firmly into its resting position in order to provide for a solid connection of the lever (44) with the multi-action cam (50) to ensure smooth rotational movements of the cam. An upward lift on the lever (44) translates into a downward pressure in the center of the multi action rotational cam (50) to release the seat height gas spring (62) for height adjustment, meaning that the gas spring (62)will push the seat upward, while sitting on it will push it down. Release of the lever (44) to the normal position locks the seat in place at the chosen height. The seat height gas spring (62) is mounted inside the chair column (34).—When the lever (44) is lifted in the upward direction $a_1$, it translates to the movement $a_2$ which causes the adjustment of the seat height.

B. Back support adjustment. As the multi action cam (50) is turned by means of the lever (44), its back tilt cam protrusion (20, FIG. 2*a*) displaces the back actuator slide (14). The back actuator slide transmits the displacement to the back actuator rod (12) to release the back tilt gas spring (22) which exerts pressure at the axis Q to move the back support attachment (16) forward as the lever Q-R pivots around the axis P. To find the desired position, the user leans against the back support until he is comfortable. Bringing the lever (44) forward will lock the back support in the desired position. —Since the entire seat and back support assembly can tilt around the axis T, the back actuator slide (14) has a curved sliding surface for the back actuator rod (12) to ride on, irrespective of the tilt of the assembly. —When the lever (44) is moved in the rotational direction $b_1$ in the first position, it translates to movement $b_2$ which causes the adjustment of the back support.

Figure 2B:
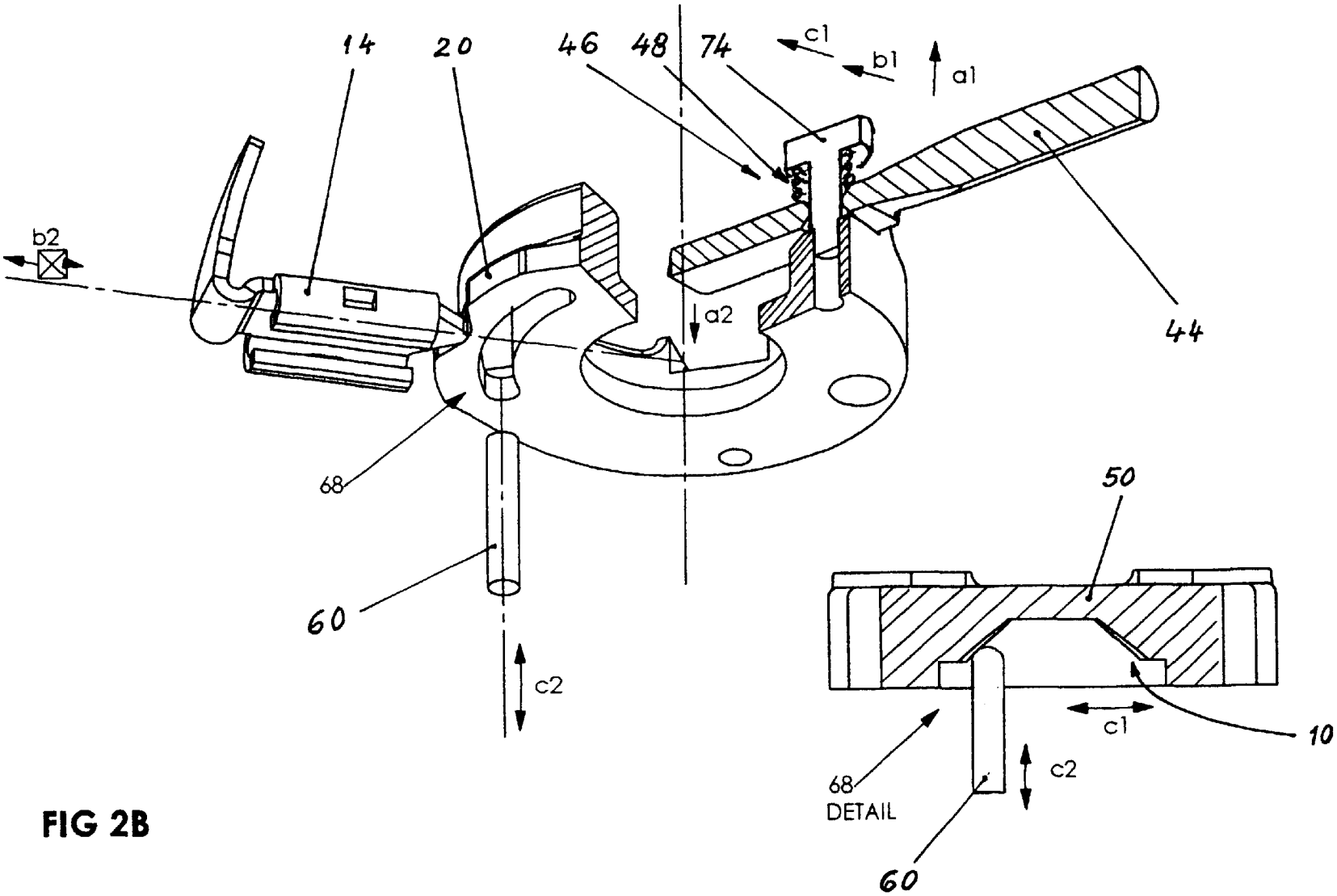
FIG. 2*b* shows the multi-action cam (50), in particular the lever (44) whose upward motion a, translates into a downward motion $a_2$ to release the seat height gas spring (62), the back tilt cam (20) which translates the rotation $b_1$ into a radial displacement $b_2$ of the back actuator slide (14), and the seat tilt cam (68) which translates the rotation $c_1$ into a vertical displacement $c_2$ of the seat actuator rod (60).

C. Seat tilt adjustment. To accommodate personal preferences and specific task requirements, the seat can tilt through a range of 20° including a fine adjustment of 10° that is illustrated in FIG. 3. As the multi action cam (50) is turned beyond the point of releasing the back tilt gas spring (22) by means of the lever (44), the seat actuator rod (60) is pushed down as it rides on the activation slope (10, FIG. 2*b*). The seat actuator rod (60) transfers its displacement onto the seat pivot actuator (66) which releases the seat tilt gas spring (70). The released seat tilt gas spring (70) exerts pressure onto the axis S causing the entire seat assembly to turn counterclockwise around the tilt axis T. The user pushes the seat back as desired and moves the lever (44) forward to lock the seat in the desired tilt position by allowing the seat actuator rod (60) to retreat into its resting position inside multi-action cam (50) thus removing the release pressure on the seat tilt gas spring. Then the user adjusts the back support as described above and moves the lever forward to its resting position to lock in all adjustments. —When the lever (44) is moved in the rotational direction $c_1$, it translates into the movement $c_2$ on rod (60) which causes the adjustment of the seat tilt.

Figure 4:
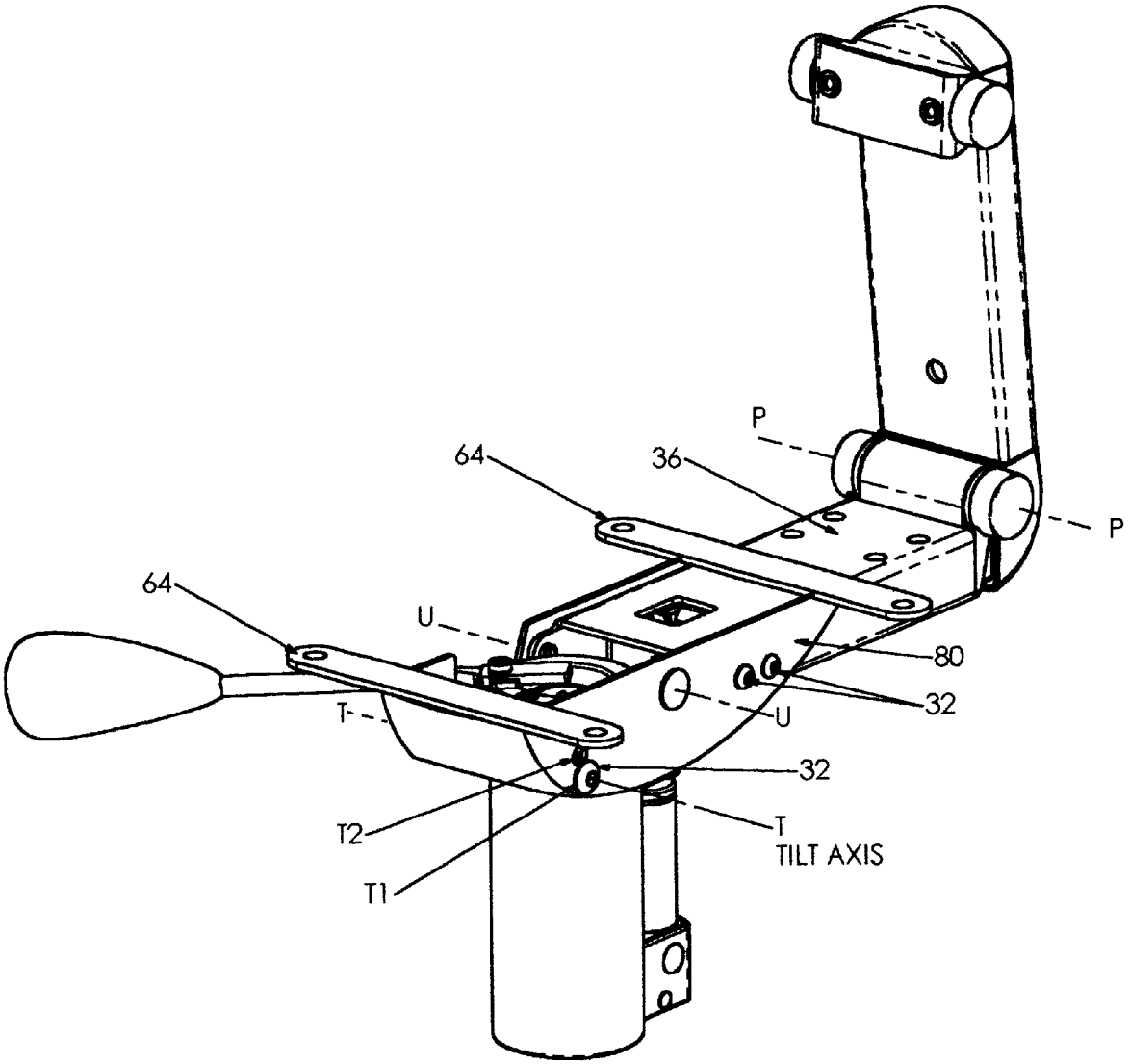
FIG. 4 gives a perspective view of the seat and back tilt adjustment mechanism in relation to the single lever and the multi-action cam.

FIG. 4 shows the design of the chair adjustment mechanism from above, exposing the seat mounts (64). It also shows the coarse adjustment for the seat tilt. To increase the tilt by 10°, the three button head screws (32) must be removed from both sides. Then, the tilt frame (80) can be turned around the axis U by 10° against the channel (36). The button head screws (32) are then inserted into position $T_2$ and into an extra set of threaded holes (not shown) in the back of the tilt frame (80).

Figure 5:
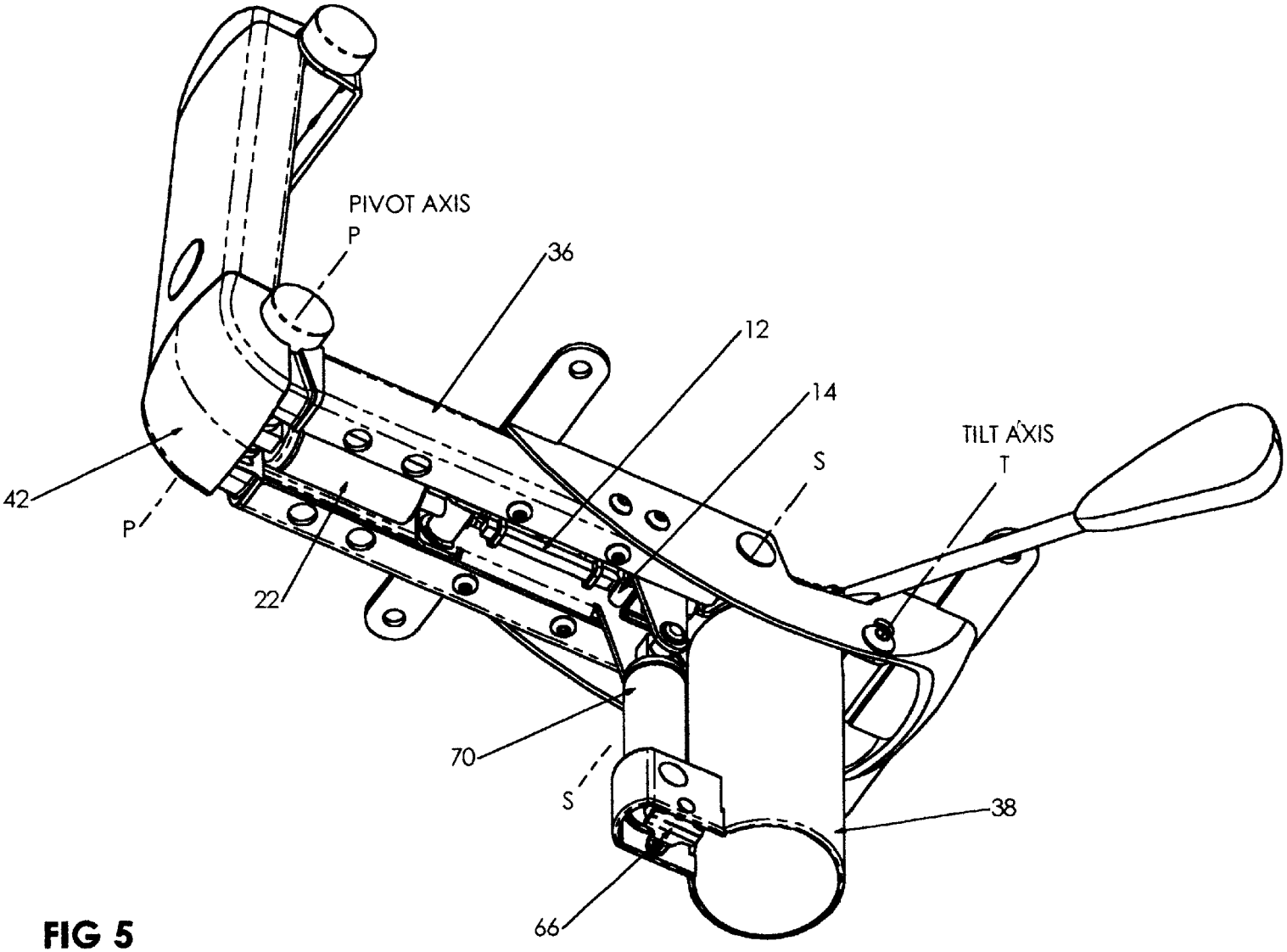
FIG. 5 gives a perspective view of the underside of the mechanism for seat tilt and back tilt with the back actuator rod (12) that releases the back tilt gas spring. (22)

FIG. 5 shows details of the seat tilt fine adjustment and the back support adjustment. The lower end of the seat tilt gas spring (70) is held in a U-shaped bracket that is welded to the column tube (38). This bracket also houses the seat pivot actuator (66) which releases the gas spring (70) when turned by the seat actuator rod (60, FIG. 3). The other end of the seat tilt gas spring (70) is hinged at the axis S between two protrusions of the channel (36). Thus, the lever T-P pivots around the tilt axis T with the adjustment force being applied at the axis S. —FIG. 5 also shows the back actuator rod (12) that transmits the displacement of the back actuator slide (14) to release the back tilt gas spring (22) for the back support pivot adjustment. The lever arrangement Q-P (FIG. 3) is covered by the joint cover (42).

What is claimed is:

1. A mechanical device for adjusting the position of a seat mounted on a frame and a seat back mounted on said seat frame, said device comprising:

a control element constructed with first and second cam surfaces, said element mounted on said seat frame for movement therewith and for rotation thereon, said control element having an access opening therein;

a first actuator for adjusting said seat in a vertical direction, said first actuator having first triggering means;

a second actuator for pivoting said seat about a first horizontal axis, said second actuator having second triggering means engaging said first cam surface for triggering movement of said second actuator;

a third actuator for pivoting said seat back about a second horizontal axis, said third actuator having third triggering means engaging said second cam surface;

a lever pivotally mounted on said control element for rotation in vertical and horizontal operational planes and extending radially thereon, said lever having an inner end, positioned to engage said first triggering means through said access opening and an outer end which is positioned for rotational movement by a user in said operational planes;

wherein movement of said lever in said vertical plane triggers movement of said first actuator and movement of said lever in said horizontal operational plane moves said first and second cam surfaces to trigger movement of said second and third actuators.

2. A mechanical device for adjusting the position of a seat mounted on a frame and a seat back mounted on said seat frame, said device, according to claim 1, wherein:

said control element comprises an annular shaped body including upper and lower radially extending surfaces and a circumferential surface, said body having a central axis and an axially extending access passage constructed therein;

said first cam surface is constructed in said lower radially extending surface, at an upper portion of a groove, said groove extending parallel to said axis of said body, said upper portion formed to provide a vertically varying cam surface; and said second cam surface is constructed in a portion of said circumferential surface, said surface portion formed to provide a radially varying cam surface.

3. A mechanical device for adjusting the position of a seat mounted on a frame and a seat back mounted on said seat frame, said device, according to claims 1 or 2, wherein said second triggering mechanism comprises a rod mounted for vertical movement on said frame and having upper and lower ends, wherein said upper end engages said first cam surface and said lower end is operatively connected to the second actuator.

4. A mechanical device for adjusting the position of a seat mounted on a frame and a seat back mounted on said seat frame, said device, according to claims 1 or 2, wherein said third triggering means includes a curved intermediate link operatively engaging said second cam surface, said intermediate link providing a continuous engagement surface for said third triggering means as said seat is adjusted.

5. A mechanical device for adjusting the position of a seat mounted on a frame and a seat back mounted on said seat frame, said device, according to claim 1, wherein said lever is spring biased to lock the first actuator from movement.

6. A mechanical device for adjusting the position of a seat mounted on a frame, said device comprising:

a control element constructed with a cam surface, said element mounted on said seat frame for movement therewith and for rotation thereon;

a first actuator for adjusting said seat in a vertical direction, said first actuator having first triggering means;

a second actuator for pivoting said seat about a first horizontal axis, said second actuator having a second triggering means engaging said cam surface for triggering movement of said second actuator;

a lever pivotally mounted on said control element for rotation in vertical and horizontal op planes and extending radially thereon, said lever having an inner end, positioned to engage said first triggering means and an outer end which is positioned for rotational movement by a user in said operational planes;

wherein movement of said lever in said vertical plane triggers movement of said first actuator and movement of said lever in said horizontal operational plane moves said cam surface to trigger movement of said second actuator.

7. A mechanical device for adjusting the position of a seat mounted on a frame and a seat back mounted on said seat frame, said device, according to claim 6, wherein:

said control element comprises an annular shaped body including upper and lower radially extending surfaces and a circumferential surface, said body having a central axis and an axially extending access passage constructed therein; and said cam surface is constructed in said lower radially extending surface, at an upper portion of a groove, said groove extending parallel to said axis of said body said upper portion formed to provide a vertically varying cam surface.

8. A mechanical device for adjusting the position of a seat mounted on a frame and a seat back mounted on said seat frame, said device, according to claims 6 or 7, wherein said second triggering mechanism comprises a rod mounted for vertical movement on said frame and having upper and lower ends, wherein said upper end engages said cam surface said lower end is operatively connected to the second actuator.

9. A mechanical device for adjusting the position of a seat mounted on a frame and a seat back mounted on said seat frame, said device, according to, claim 7, wherein said inner end of said lever engages said first triggering means through said access passage.

* * * * *